US007971373B2

(12) United States Patent
Epping

(10) Patent No.: US 7,971,373 B2
(45) Date of Patent: Jul. 5, 2011

(54) SUPPORT SLEEVE FOR THIN AND/OR HIGH HEELS ON LADIES' SHOES

(76) Inventor: Astrid Epping, Wohltorf (DE)

( * ) Notice: Subject to any disclaimer, the term of this patent is extended or adjusted under 35 U.S.C. 154(b) by 808 days.

(21) Appl. No.: 11/936,390

(22) Filed: Nov. 7, 2007

(65) Prior Publication Data

US 2008/0196279 A1 Aug. 21, 2008

(30) Foreign Application Priority Data

Feb. 20, 2007 (DE) ..... 20 2007 002 466 U
Aug. 17, 2007 (DE) ..... 20 2007 011 571 U

(51) Int. Cl.
*A43B 21/36* (2006.01)

(52) U.S. Cl. ..... 36/42; 36/72 B

(58) Field of Classification Search ..... 36/42, 72 B, 36/35 A, 41, 36 R, 40
See application file for complete search history.

(56) References Cited

U.S. PATENT DOCUMENTS 1,422,446 A * 7/1922 Kaplan ..... 36/72 B
1,439,104 A * 12/1922 Helwitz ..... 36/72 B
1,875,806 A * 9/1932 Givens ..... 36/72 B
2,908,089 A * 10/1959 Ciaio ..... 36/36 R
3,035,357 A 5/1962 Valenti
3,122,848 A * 3/1964 Grossman ..... 36/7.3
3,439,435 A * 4/1969 Fredon ..... 36/72 R
5,357,694 A 10/1994 Mauck

* cited by examiner

*Primary Examiner* — Ted Kavanaugh
(74) *Attorney, Agent, or Firm* — Richard M. Goldberg

(57) ABSTRACT

A support sleeve for high heels on ladies's shoes with a sleeve body to accommodate a heel, the sleeve body having a substantially larger base than the base of the heel to be accommodated, and a fixing arrangement (36, 38, 46) for attaching it to the heel.

15 Claims, 2 Drawing Sheets

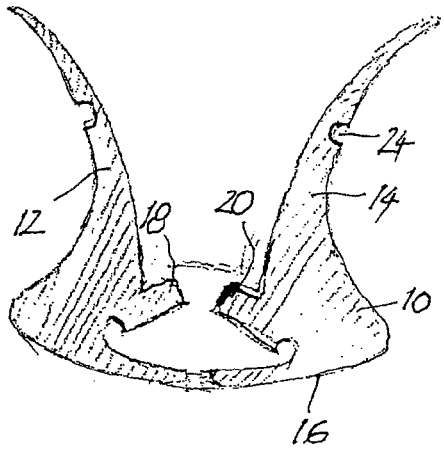
Fig 1.
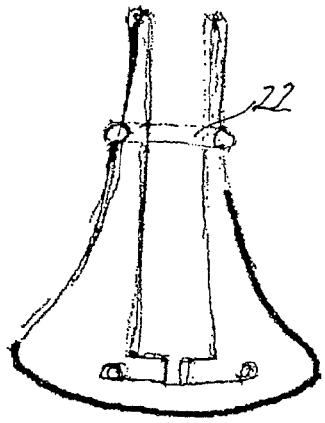
Fig.2
Fig.3
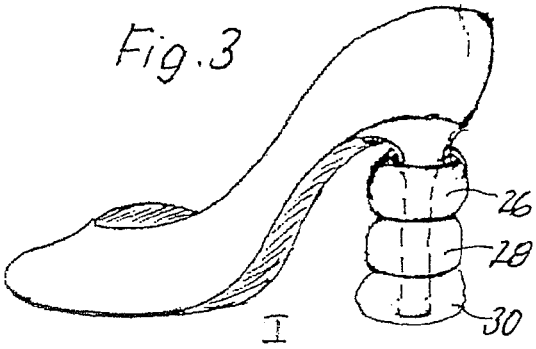
Fig 4
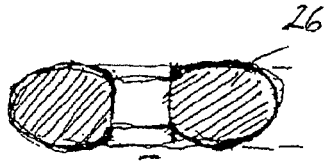
Fig.5
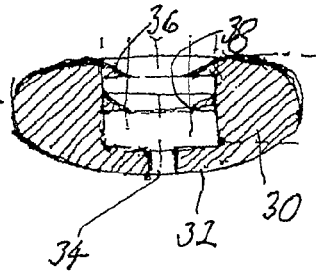
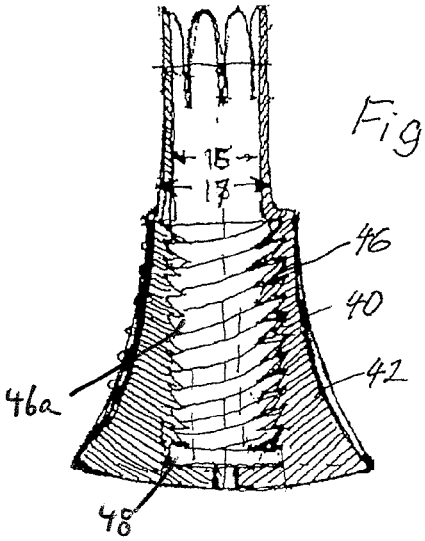
Fig 6
Fig.7
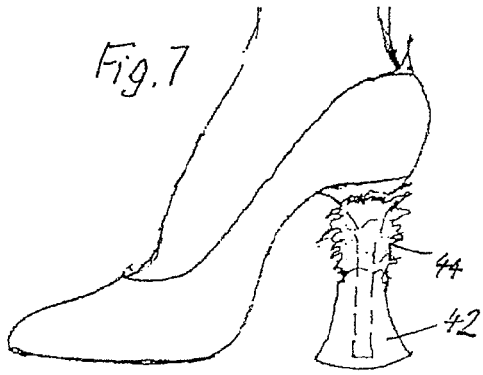

SUPPORT SLEEVE FOR THIN AND/OR HIGH HEELS ON LADIES' SHOES

The invention concerns a support sleeve for thin and/or high heels on ladies' shoes.

BACKGROUND OF THE INVENTION

So-called "high heels" on ladies' shoes generally have only a very small contact surface, hence they exert a correspondingly high pressure on the ground. Walking with such shoes therefore poses a problem on numerous surfaces. This is true of, for example, lawn, cobbled streets, gravel paths and surfaces with holes in the ground such as manhole covers, grating, timber boards, etc. The high pressure exerted means there is a risk not only of the wearer sinking into soft surfaces such as lawns, but also of said high pressure doing damage to numerous surfaces such as parquet floors, synthetic floors, etc.; as a result, access to such floors is often barred to wearers of high-heeled shoes, at least in public buildings.

There are numerous proposals for sleeve-shaped structures for attaching, or at least pushing onto, high-heeled ladies' shoes. Insofar as said structures are not purely decorative, the main concern is to protect the shoe heels when driving. Other proposals are aimed at providing the means of effecting an emergency repair to a damaged or broken high heel. The reader is referred to U.S. Pat. No. 3,035,357 and U.S. Pat. No. 5,357,694 with regard to the state of the art.

SUMMARY OF THE INVENTION

The invention is based on the task of creating a device to allow the wearers of thin and/or high-heeled shoes to walk with sufficient support across soft or irregular surfaces.

The solution to this task consists of a support sleeve for high-heeled ladies' shoes with a sleeve body for accommodating a heel, said sleeve body having a substantially larger base than the base of the heel to be accommodated, and fixing means for attaching it to the heel.

This type of sleeve-shaped structure allows the wearer's weight to be distributed over a surface which is substantially larger than the base of the accommodated heel. The surface pressure is therefore considerably less than that generated by the heel to be accommodated, thereby avoiding damage to sensitive wood and synthetic flooring. Neither is there any risk of sinking into lawns or gravel paths.

The support sleeve according to the invention should be lightweight and designed to be fitted onto a shoe heel in just a few movements. This facilitates standing and walking considerably. Depending on the type of embodiment, the step can be cushioned to relieve the strain on the back and spine. The heels themselves are protected from damage.

The inside of the support sleeve is preferably provided with a receiving surface which directly or indirectly transfers the vertical force exerted by the heel to the base of the support sleeve. The support sleeve therefore preferably has a bottom on which the normal shoe heel rests. Alternatively, the support sleeve may also envelope the heel so tightly that the vertical forces are transferred via the walls of the heel and the inner wall of the support sleeve. Suitable means for accommodating the shoe heel include gel cushions containing gels which undergo a change of viscosity depending on the type of stress to which they are exposed, becoming essentially rigid, for example, when exposed to higher shear forces (thixotrophy, rheology).

Alternatively, the support sleeve may be comprised of a plurality of individual rings, made out of an elastomer material, for example, of which the bottom ring must naturally have a stiff base.

In another preferred embodiment there are elastic circumferential rings, or thread turns, on the inner circumferential surface, which are displaced by the penetrating shoe heel, and hold the heel firmly in place after insertion.

One advantageous support sleeve has a sleeve body where the inside of the sleeve bore is provided with projecting ribs forming a thread turn such that the support sleeve can be screwed onto the heel from the bottom up.

The support sleeve is preferably closed at one end by a base, which one might also call a support cap. The support cap is screwed onto the high heel from the bottom up, thereby considerably increasing the heel contact surface. It may only be considered a genuine support sleeve if a plurality of support sleeves and a support cap are fitted over a very high heel. This may be a consideration when, for example, the support sleeves are used for their decorative effect, amongst other things, and a buffer effect is desired to prevent a hard step.

The support sleeve is preferably made from elastic TPU or silicone rubber. The job of determining the Shore hardness may be left to a person skilled in the art. On the one hand, the ribs with the thread turns on the inside of the sleeve bore must be relatively soft so that they do not damage fragile heels. On the other hand, the closed base must be stable enough to support the load of the heel. The support sleeve could, therefore, be of varying hardness in varying places.

The outside of the support sleeve need not be essentially cylindrical in shape as the term "sleeve" might suggest. The outside of the support sleeve may rather have a rounded, even spheroidal shape. Thus, the shape of the support sleeve in particular may be made subordinate to visual, decorative aspects. This may be achieved through colour, and indeed, through shape. For example, the outside of the spheroidal support sleeve may feature levelled facets, for example, and create the impression of a polished stone.

The thread-shaped ribs on the inside of the sleeve bore may essentially have wedge-shaped backs, thereby allowing them to firmly grip the heel to be protected. On the other hand, they should not cause any damage to heels covered with fine leather, for example. Thus the material should preferably be relatively soft, particularly in the vicinity of these thread turns.

In one preferred embodiment, the support sleeve comprises one or a plurality of elastic rings which can be consecutively pushed onto the heel to cover it along its full height.

Insofar as the support sleeve does not encompass the full height of the heel, a flexible cuff can be provided on the support sleeve in the upper portion of the heel, which can be compressed in the manner of a concertina if the heel height is correspondingly lower.

In designing the support sleeve, fashion aspects may naturally also play a role. If several plastic rings are used, each one can be coloured differently, for example.

Where support sleeves encase the heel tightly, a vent hole can be provided in the base, for example, or in a discreet lateral position.

The shape of the base of the support sleeve can be chosen at will. Fashion aspects may play a role here, too. One might choose, for example, a base shaped like a conventional larger heel, or a quadratic, round or corner-rounded base.

A simpler technical solution would be feasible if shoe producers were to provide a means of attachment, preferably on the inner, or front, side of the heel. The support sleeves could then be sold together with the shoes. The present invention embraces this possibility, as well as separate, universally deployable support sleeves.

BRIEF DESCRIPTION OF THE DRAWINGS

Preferred embodiments of the invention, will be explained, in more detail with reference to the enclosed drawings, in which FIG. 1 shows an embodiment of a support sleeve according to the invention, in the opened form;

FIG. 2 shows the support sleeve of FIG. 1 in the closed form;

FIG. 3 is a perspective view of another embodiment of the support sleeve according to the invention;

FIG. 4 shows a cross-section through one of the upper rings in FIG. 3;

FIG. 5 shows a cross-section through the lower ring in FIG. 3;

FIG. 6 is a vertical section through another embodiment of the support sleeve according to the invention; and FIG. 7 shows the embodiment of FIG. 6 positioned on the heel of a shoe;

DETAILED DESCRIPTION

Figure 8:
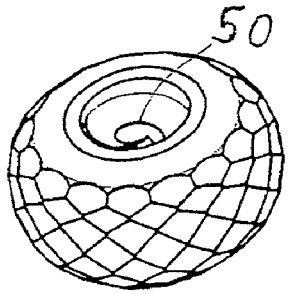
FIG. 8 is a perspective view of another embodiment of the support sleeve.

FIG. 1 shows a vertical section of support sleeve according to the invention in the open position. The support sleeve is designated by 10. The support sleeve can be opened like a calyx and then, after insertion of a shoe heel, reclosed around it. To this end, the support sleeve is provided with individual, outwardly bendable strips 12,14, which, proceed from the circumference of a base 16. In the lower inner area, the strips are provided with inwardly directed projections 18,20, on which an inserted shoe heel bears down. This action tends to bend the strips inwards.

Strips 12,14 are positioned around the shoe heel (not shown) and pressed together. A rubber ring rolled onto the heel in advance, an O-ring 22 (FIG. 2), for example, can be rolled down onto the support sleeve from the top end of the heel and come to rest in a circumferential groove 24 on the outside of strips 12,14.

In this manner, the strips remain in the closed position, around the shoe heel, shown in FIG. 2. It can be seen that the contact surface of the shoe heel inserted inside the support sleeve is considerably smaller than that of support sleeve 10, whose base 16 has a lens-shaped curvature in the embodiment illustrated here. A suitable stiffener, a sheet metal plate, for example, can be inserted in the base construction.

FIG. 3 shows another embodiment of the invention. This embodiment is particularly suited for heels of varying height, as it is comprised of individual superimposed rings 26,28,30 made from elastomer materials such as natural rubber or silicone rubber or an elastomer plastic. The cross-sections of the individual rings are shown in FIGS. 4 and 5. Ring 26 in the upper position is a simple, elastic ring, whereas ring 30 in the bottom position has a rigid base 32, on which the shoe heel to be accommodated must rest. This base 32 is further provided with a vent hole 34, which is a good idea if the heel is accommodated under airtight conditions. A plug, not shown, can be provided for sealing the vent hole 34.

On the inside of ring 30 in the opening intended to accommodate a shoe heel, there are ribs or fins 36,38 running around the circumference in the form of two rings positioned one above the other, which serve to hold the lower ring on the heel.

FIGS. 6 and 7 relate to another embodiment of the invention. The support sleeve 40 shown in a vertical section in FIG. 6 consists of a lower, rigid part 42 and an upper, soft, thin-walled part, 44, which serves to cover the upper part of the accommodated heel and allows adjustment to the heel height.

If the heel is lower, the upper, flexible part 44 can he compressed like a harmonica, or rolled up like a roll neck, or compacted by other means. This is illustrated in FIG. 7.

The lower part is made from relatively stiff material and its inner wall is provided with circumferential ribs or fins, 46, which are contrived in the embodiment illustrated as a form of thread turns. The ribs 46 have a triangular-shaped cross-sectional configuration with a sharp inwardly extending edge 46*a*. These ribs 46 serve to hold support sleeve 40 on the heel of a shoe. In the lower portion of the opening to accommodate the heel there is an insert of harder material, namely, a rigid plate 48 on which the heel rests.

In a further embodiment, a support sleeve according to the invention can be formed by a spring contrived in the shape of a screw, which is covered with a rubber-like material made from natural or silicone rubber. To achieve an enlarged contact surface with this type of solution, the end of the screw spring can be flattened and closed in the centre. The screw shape ensures an excellent transfer of the vertical forces to the support sleeve.

FIG. 8 shows another embodiment of the support sleeve according to the invention. It can be seen that the support sleeve is indeed shaped like a sleeve, and has an inner hollow space, but the outer form is markedly spherical and further provided with facets for the purpose of decoration. Furthermore, a thread turn comprised of elastic ribs is suggested on the inside, said ribs forming a thread turn 50, allowing the support sleeve to be properly screwed onto a high heel. In this manner the support sleeve sits firmly on the heel without any risk of causing damage to the heel when the support sleeve is attached.

Figure 10:
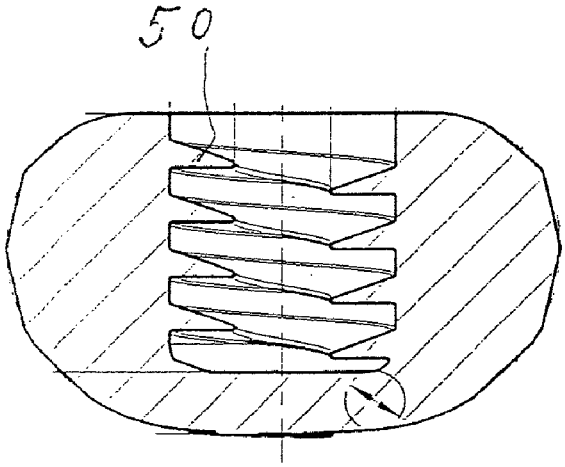
FIG. 10 is an enlarged perpendicular section through this embodiment.

FIG. 10 shows an enlarged vertical section through a support sleeve of FIG. 8. Thread turn 50 inside the sleeve bore can be seen with particular clarity in FIG. 10. The markedly rounded outer form is also recognisable.

It can be seen that the backs of ribs 50, which are inwardly directed, are tapered to a wedge shape. In this way the ribs can be easily screwed onto the shoe heel, and they provide a relatively firm grip on the heel.

Figure 9:
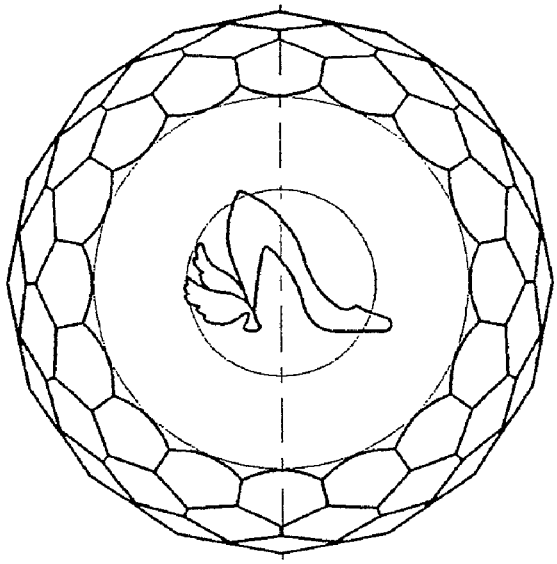
FIG. 9 is a view from the underside of the support sleeve.

FIG. 9 shows a support sleeve according to the invention from the underside. The facet-shaped design of the outside of the support sleeve may be seen here, too. The support sleeve illustrated here may be supplemented by additional elastic support sleeves which are constructed according to the same principle as the support sleeve shown here, but do not have a closed base. With a plurality of such support sleeves the heel can be covered over its entire height, and a buffer effect is created during contact with the ground. The support sleeve itself can be formed from rings such as these, which encase the heel over its entire height.

What is claimed is:

1. Support sleeve for high-heeled ladies' shoes having a heel with a base, the base having a lower surface of a first area, said support sleeve comprising:

a sleeve body for accommodating the heel, said sleeve body having a base with a second area which is substantially larger than the first area of the base of the heel to be accommodated, the sleeve body having a sleeve bore, and a fixing arrangement for attaching the sleeve body to the heel, the fixing arrangement including projecting ribs forming a thread turn at an inside of the sleeve bore in such a manner that the support sleeve is adapted to be screwed up onto the heel from a bottom thereof, the thread-shaped ribs on the inside of the sleeve bore have a triangular-shaped cross-sectional configuration with a sharp inwardly extending edge.

2. The support sleeve of claim 1, wherein an inside of the support sleeve is provided with a receiving surface, which one of directly and indirectly transfers a vertical force exerted by the heel to the base of the support sleeve.

3. The support sleeve of claim 1, wherein the ribs extend circumferentially around an inner circumference of the support sleeve to grip the heel.

4. The support sleeve of claim 1, wherein an upper portion of the support sleeve is provided with a flexible cuff which bridges an upper heel end of the heel and can be one of folded and rolled up.

5. The support sleeve of claim 1, wherein an inside of the support sleeve is provided with a gel cushion.

6. The support sleeve of claim 5, wherein the gel cushion is made of a gel material whose viscosity alters depending on impaction of force, and is thereby a thixotropic material.

7. The support sleeve of claim 1, wherein the support sleeve is contrived as a cap which is closed at one end.

8. The support sleeve of claim 1, wherein the support sleeve is made from silicone rubber.

9. The support sleeve of claim 1, wherein the support sleeve is made from elastic TPU.

10. The support sleeve of claim 1, wherein the support sleeve is spherical shaped.

11. The support sleeve of claim 1, wherein the support sleeve has an exterior surface contrived with facets.

12. The support sleeve of claim 1, further comprising an insert of harder material positioned inside a closed base of the support sleeve.

13. The support sleeve of claim 12, wherein the harder material is metal.

14. The support sleeve of claim 1, wherein the material of the support sleeve has different hardnesses at different locations.

15. The support sleeve of claim 1, wherein the support sleeve comprises at least one elastic ring which, when screwed onto the heel, cover the heel over its entire height.

* * * * *